US009694490B2

(12) United States Patent
Wang

(10) Patent No.: US 9,694,490 B2
(45) Date of Patent: Jul. 4, 2017

(54) FLEXIBLY COMBINABLE TOOL BOX

(71) Applicant: Shyh-Ming Wang, Taichung (TW)

(72) Inventor: Shyh-Ming Wang, Taichung (TW)

( * ) Notice: Subject to any disclaimer, the term of this patent is extended or adjusted under 35 U.S.C. 154(b) by 0 days.

(21) Appl. No.: 15/011,349

(22) Filed: Jan. 29, 2016

(65) Prior Publication Data

US 2016/0144501 A1 May 26, 2016

Related U.S. Application Data

(63) Continuation-in-part of application No. 14/147,536, filed on Jan. 5, 2014, now abandoned.

(51) Int. Cl.
*B25H 3/02* (2006.01)
*B25H 3/06* (2006.01)

(52) U.S. Cl.
CPC ..... *B25H 3/023* (2013.01); *B25H 3/028* (2013.01); *B25H 3/06* (2013.01)

(58) Field of Classification Search
CPC ..... Y10T 16/544; Y10T 16/5445; Y10T 16/547–16/548
USPC ..... 16/221, 229, 366–370
See application file for complete search history.

(56) References Cited

U.S. PATENT DOCUMENTS 3,908,227 A 9/1975 Cain
3,924,293 A 12/1975 Cain
4,570,290 A 2/1986 Anderson
4,594,750 A 6/1986 Carcas
4,684,017 A 8/1987 Watanabe et al.
5,274,882 A 1/1994 Persson
5,325,966 A 7/1994 Chang
5,325,984 A 7/1994 Ady et al.
5,493,760 A 2/1996 Takimoto
5,711,428 A 1/1998 Ho
6,062,385 A 5/2000 Cho
6,450,354 B2 9/2002 Chien
6,901,937 B2 6/2005 Sebban
7,155,780 B2 * 1/2007 Chen ..... H04M 1/0216 16/326
7,828,167 B2 * 11/2010 Nolan ..... E05D 7/1011 220/6
7,900,323 B2 * 3/2011 Lin ..... F21S 6/003 16/254
8,016,108 B1 9/2011 Hung
8,773,849 B2 * 7/2014 Bohn ..... H04M 1/022 361/679.27
2003/0121928 A1 7/2003 Chou
2004/0188293 A1 9/2004 Lee
2005/0224380 A1 10/2005 Hernandez, Jr. et al.
2005/0236869 A1 * 10/2005 Ka ..... G06F 1/1616 296/192

(Continued)

*Primary Examiner* — J. Gregory Pickett
*Assistant Examiner* — Brijesh V. Patel
(74) *Attorney, Agent, or Firm* — Muncy, Geissler, Olds & Lowe, P.C.

(57) ABSTRACT

A tool box is provided, including a board member and a connecting member. Each lateral face of the board member is formed with a first connecting portion, and a mounting hole is disposed in each first connecting portion. Two ends of the mounting hole are respectively formed with a second connecting portion. Each second connecting portion is detachably assembled in the mounting hole. The board member can be connected with another board member through the connecting members, and each lateral side can be connected with the board members.

13 Claims, 15 Drawing Sheets

(56) References Cited

U.S. PATENT DOCUMENTS

| | | | | |
|---|---|---|---|---|
| 2006/0026795 | A1 | 2/2006 | Tonelli | |
| 2006/0283870 | A1 | 12/2006 | Au | |
| 2007/0068836 | A1 | 3/2007 | Lin | |
| 2008/0307608 | A1 | 12/2008 | Goto | |
| 2010/0084154 | A1 | 4/2010 | Jones et al. | |
| 2012/0227217 | A1* | 9/2012 | Chen | G06F 1/1681 16/366 |
| 2013/0075292 | A1 | 3/2013 | Hsu | |
| 2013/0222990 | A1 | 8/2013 | Yu | |

* cited by examiner

FLEXIBLY COMBINABLE TOOL BOX

The present invention is a CIP of application Ser. No. 14/147,536, filed Jan. 5, 2014, the entire contents of which are hereby incorporated by reference.

BACKGROUND OF THE INVENTION

Field of the Invention

Description of the Prior Art

Most of the tool boxes on the market are composed of a box and a lid. The box and the lid are pivoted to each other and can swing relatively. The box is formed with receiving space for receiving tools; therefore, users can carry their tools with the box. However, only limited types and numbers of tools can be put into this kind of tool box, so users often have to carry different tool boxes to meet the requirements at work. Since the tool boxes are unable to be adjusted to suit users' needs, it is complicated for users to store or organize. In addition, the pivoted parts of the box and the lid of the tool box are often designed to be dislocation, so to make the tool box requires two molds, the box and the lid. Plastic molds are expensive, so the cost of manufacturing the tool box increases. Furthermore, the boxes and lids of most of the tool boxes now can only be folded up face-to-face or opened in 180 degrees, so the tool boxes cannot be assembled together in various combinations.

U.S. Pat. No. 6,901,937 discloses that the bottom and the lid are connected by a non-retractable linkage by snapping. The bottom and the lid cannot be adjustably positioned at any relative included angle. Furthermore, the recess radially or laterally open to outside, and the pip is snapped radially or laterally into the recess directly, so that the pip can disengage from the recess easily due to the recess has no closed circumferential wall to radially or laterally block the pip.

US2003/0121928 discloses that the bottom and the lid are connected by a connecting device with two retractable pin. The bottom and the lid also cannot be adjustably positioned at any relative included angle.

U.S. Pat. No. 5,274,882 discloses that the bottom and the lid are connected by two axles which are non-rotatably assembled to the bottom. The tip of the axle can pass over the V-shape groove by directly forcing the bottom and the lid to move close to or away from each other. The bottom and the lid cannot be held in a specific position stably and can be easy to rotate relatively.

The present invention is, therefore, arisen to obviate or at least mitigate the above-mentioned disadvantages.

SUMMARY OF THE INVENTION

In view of above-mentioned disadvantages, the main object of the present invention is to provide a tool box, which needs only a single mold to make a board member and can be connected on a plane or into three-dimensional structure or be piled up with connecting members.

To achieve the above and other objects, the present invention provides a tool box, including at least two board members and a connecting member, each board member having two corresponding surfaces and a plurality of lateral faces, wherein one of the surfaces is formed with at least one tool receiving portion, each lateral face is formed with at least one notch, each notch has two first sidewalls opposite to each other, each first sidewall is formed with a mounting hole and a first toothed portion, the connecting member includes a main body detachably received in one of the notch and having two second sidewalls which correspond to the two first sidewalls respectively, two blocks separately arranged, and four connecting axles, every connecting axle has a second toothed portion and a non-toothed distal portion, every two of the four connecting axles are axially retractably disposed through the two second sidewalls respectively and non-rotatable relative to the two second sidewalls respectively, each block is operable between a lock position and a release position and cooperates with two of the four connecting axles so that each of the connecting axles is axially movable between a latch position and a retracted position; wherein when respective one of the two blocks is in the lock position, respective two of the four connecting axles are driven to the latch position, every second toothed portion and every non-toothed distal portion of respective one of the connecting axles are protrusive outside one of the two second sidewalls and inserted in to one of the mounting holes, and every second toothed portion of respective one of the connecting axles is non-rotatably engaged with one of the first toothed portions; wherein when respective one of the two blocks is in the release position, respective two of the four connecting axles are driven to the retracted position, every second toothed portion and every non-toothed distal portion of respective one of the connecting axles are entirely retracted into one of the two second sidewalls.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
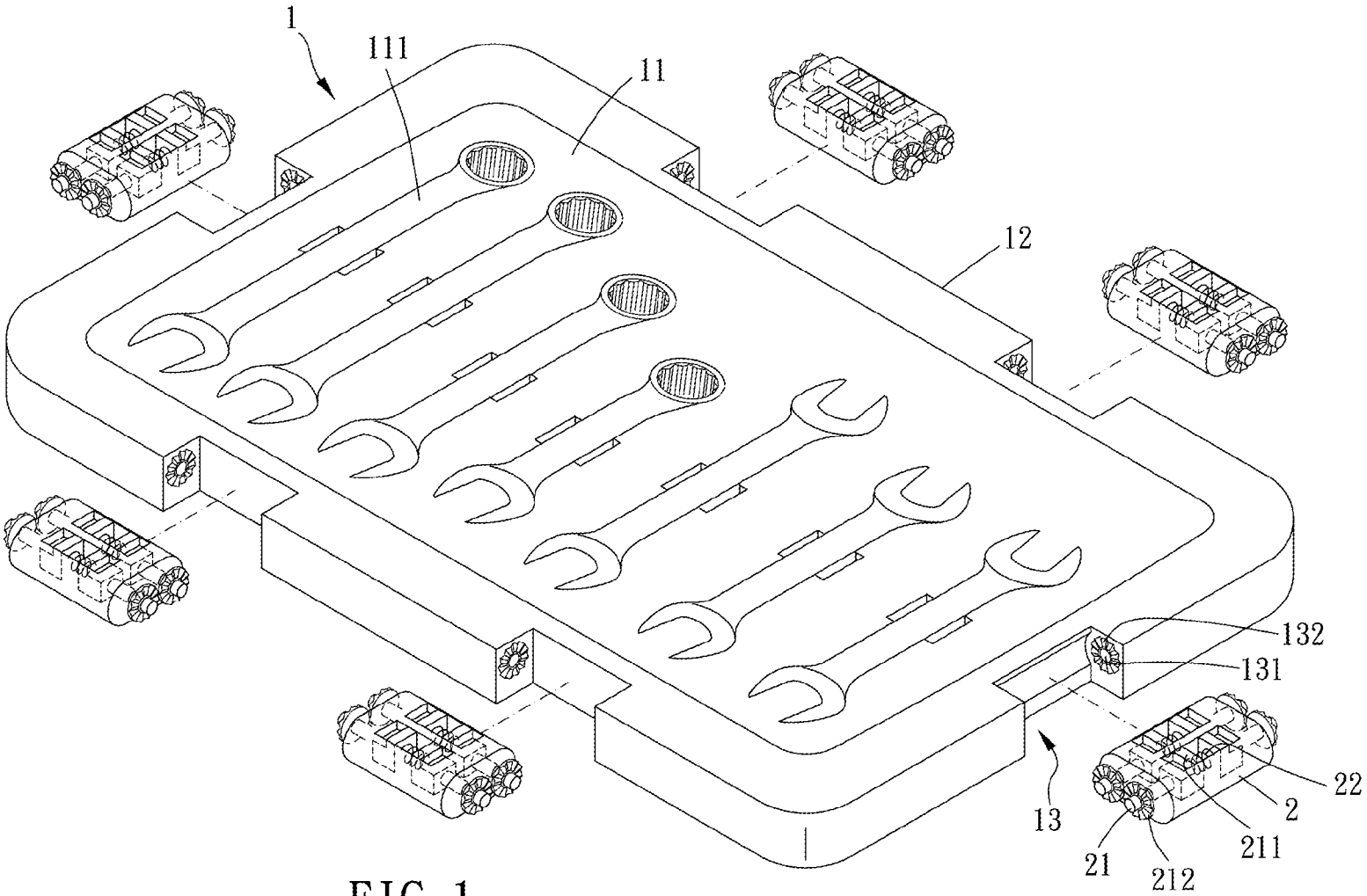
FIG. 1 is a stereogram of the present invention.

Please refer to FIG. 1 for a tool box of the present invention, including a board member 1 and a plurality of connecting members 2, and the board member 1 is a rectangle board and has two corresponding surfaces 11 and a plurality of lateral faces 12, wherein one of the surfaces 11 is formed with a plurality of tool receiving portions 111. In this embodiment, the tool receiving portions 111 are receiving troughs whose shape resemble to that of tools. A plurality of lateral faces of the board member 1 include two long lateral faces and two short lateral faces, and each long lateral face and each short lateral face are formed with at least one first connecting portion 13 (the size of the first connecting portion 13 can be increased or reduced in accordance with the size of the board member 1). The first connecting portion 13 is a recession recessed inward on the lateral face 12 of the board member 1, and the recession is disposed through the two surfaces 11 of the board member 1. Two corresponding sides of the first connecting portion 13 of each recession are formed with two mounting holes 131. Each end of the connecting member 2 is provided with a second connecting portion, and each second connecting portion is detachably assembled in the mounting holes 131.

Specifically, each second connecting portion has two retractable connecting axles 21 (the two connecting axles 21 are arranged in interval and parallel to each other). The two connecting axles 21 of the second connecting portion are assemblable in or disassemblable from the two mounting holes 131 of the first connecting portion 13 through retractability and stretchability. Preferably, each parallel connecting axle 21 is formed with two separate axial rods. An end of each separate axial rod of each connecting axle 21 is exposed, and the other end is connected with a shifting block 211. Preferably, an exposed part is protruded from the unparallel connecting end of the shifting block 211 for fingers to press or hold thereon. Each shifting block 211 used to connect the two connecting axles 21 with each other can be pressed toward the other shifting block 211 so as to drive the two connecting axles 21 to retract, and each second connecting portion is formed with an elastic member 22. Specifically, the elastic member 22 is disposed between the two shifting blocks 211 which is used to connect the separate axial rods. The elastic member 22 is abutted against the shifting block 211 to drive the two connecting axles 21 to be assemblable in or disassemblable from the mounting holes 131. When the two connecting axles 21 is disposed in the mounting holes 131, the board member 1 and the connecting member 2 will connect with each other. On the contrary, when the connecting axles 21 are removed from the mounting holes 131, the board member 1 and the connecting member 2 will separate from each other.

In addition, the first connecting portion 13 is formed with a first toothed portion 132 near the mounting hole 131. The connecting axle 21 of each second connecting portion is formed with a second toothed portion 212. When the connecting axle 21 of the second connecting portion is assembled in the mounting hole 131, the first toothed portion 132 will be position-restrictedly engaged against the second toothed portion 212. The effect of position-restricted engagement helps to decrease the friction between the board member 1 and the connecting member 2, so they will not easily get loose or pivotally swing. Furthermore, if there is no need for position-restricted engagement, in other embodiments, the first connecting portion can be pivoted to the second connecting portion, and the connecting axle can be rotatably inserted in the mounting hole so as to allow the two board members to pivotally swing through the connecting member.

Figure 2:
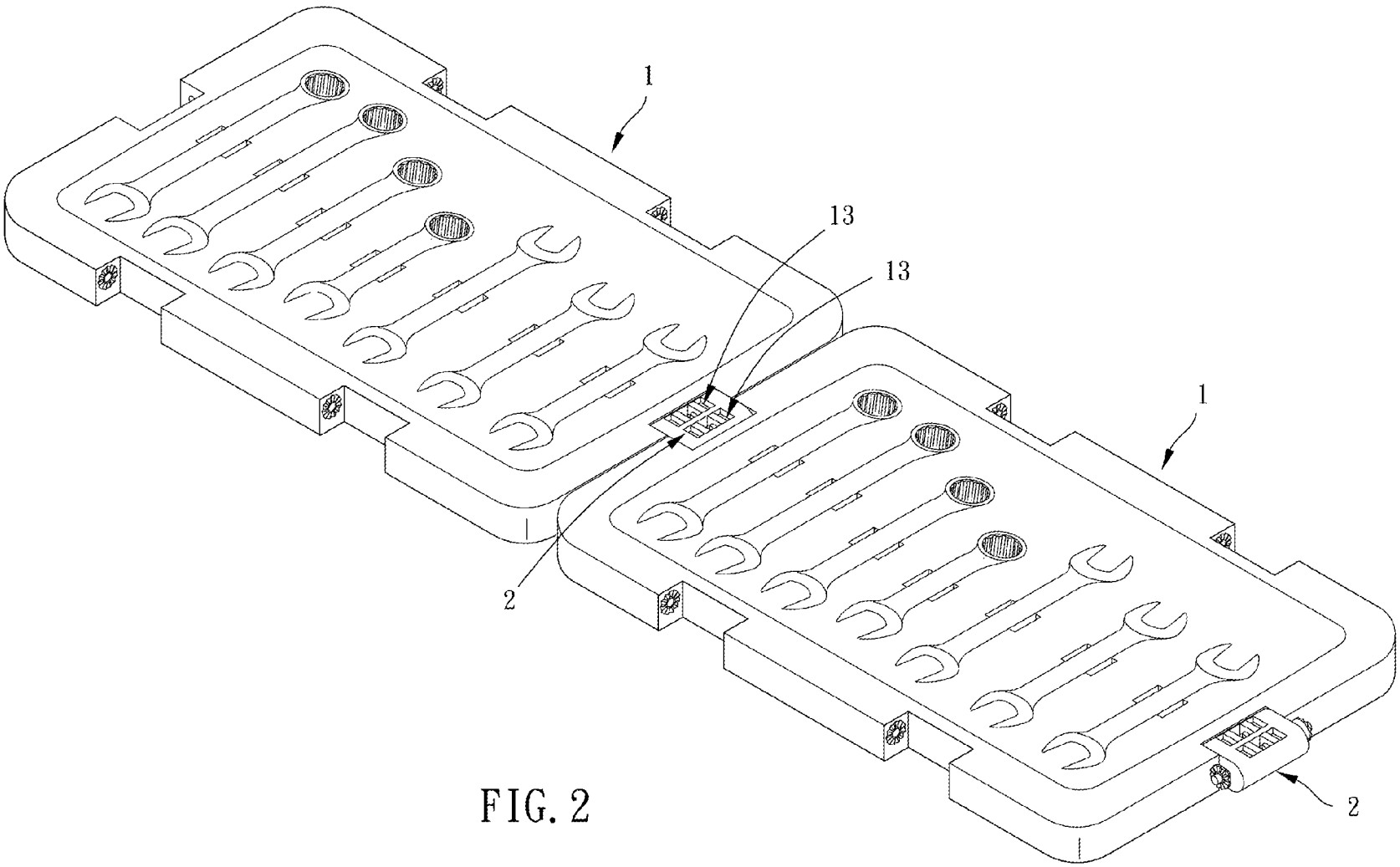
FIGS. 2 to 8 are drawings showing the present invention in use.
Figure 3:
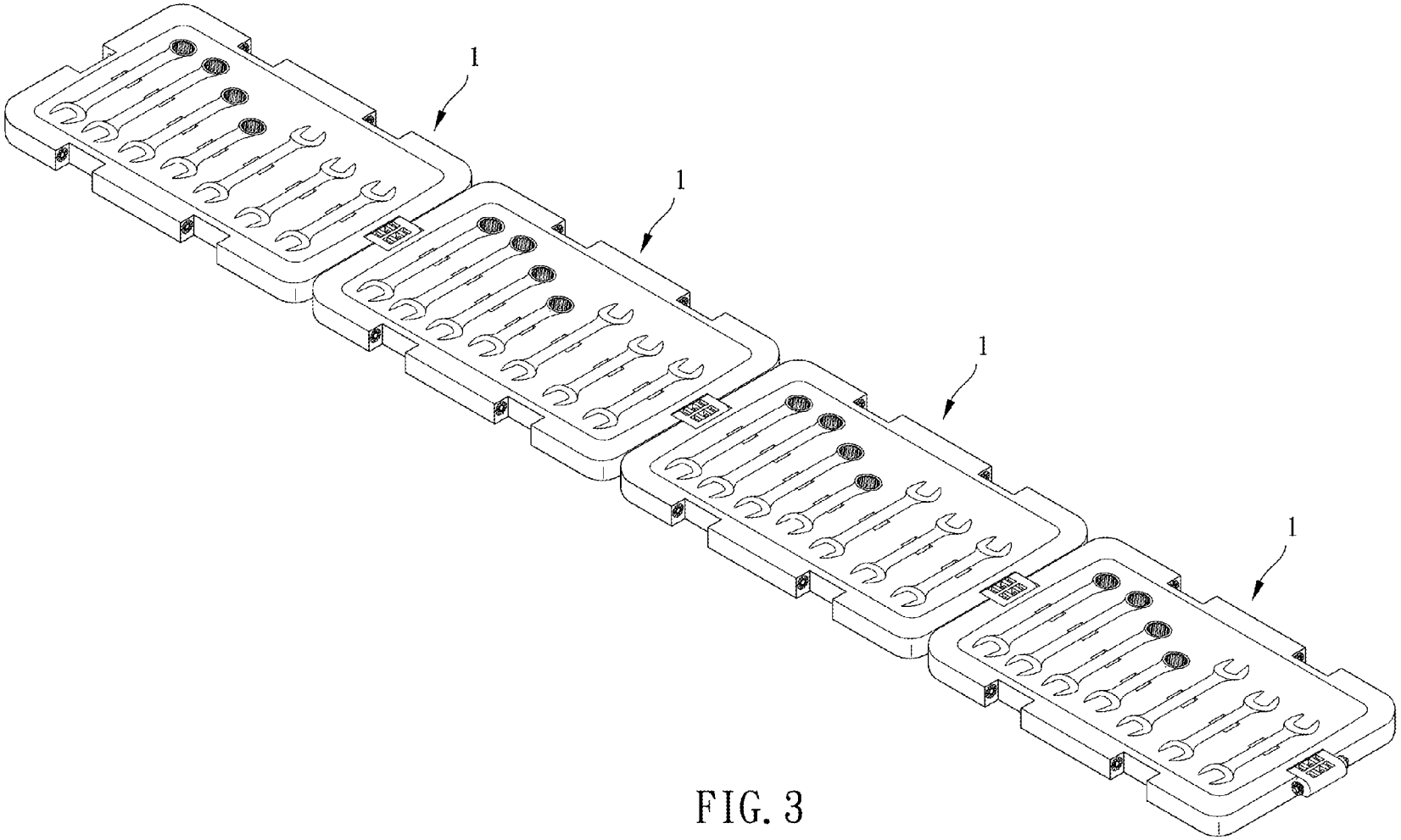
Figure 4:
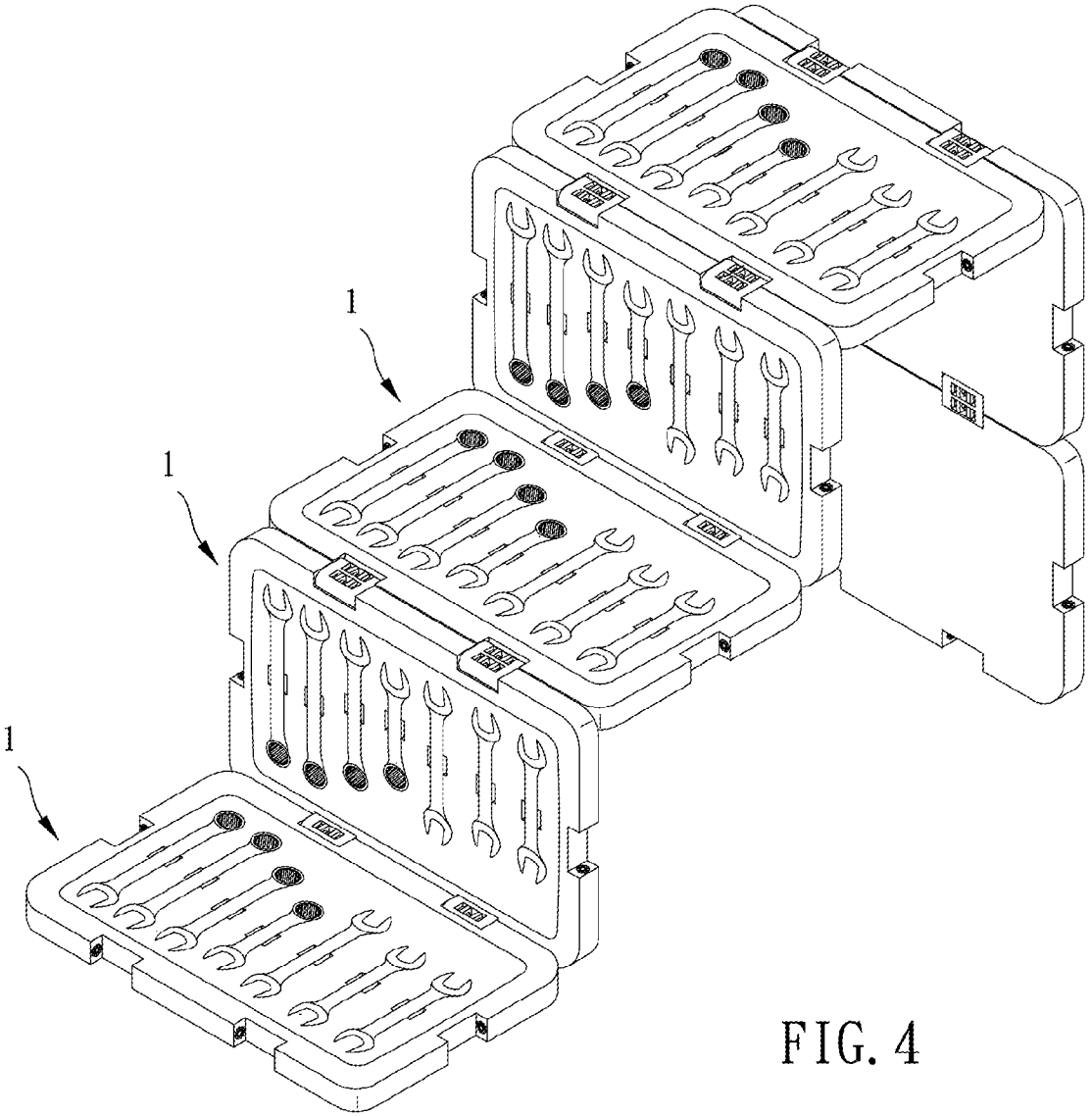
Figure 5:
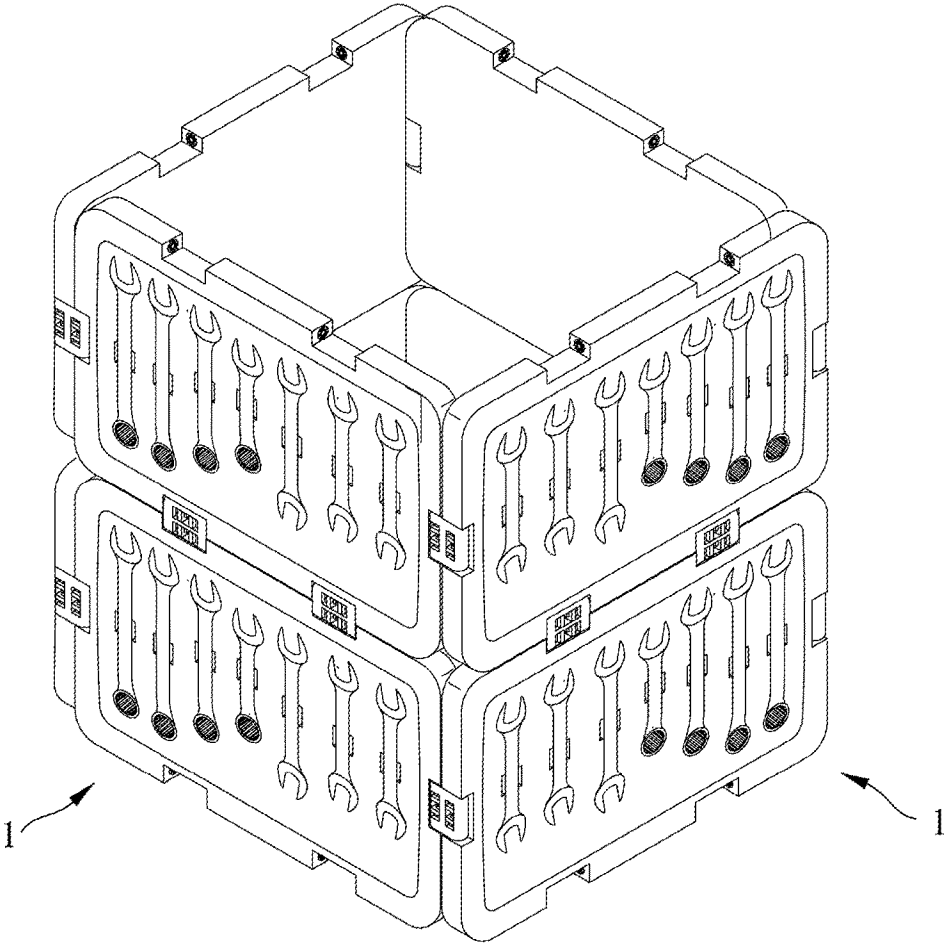
Figure 8:
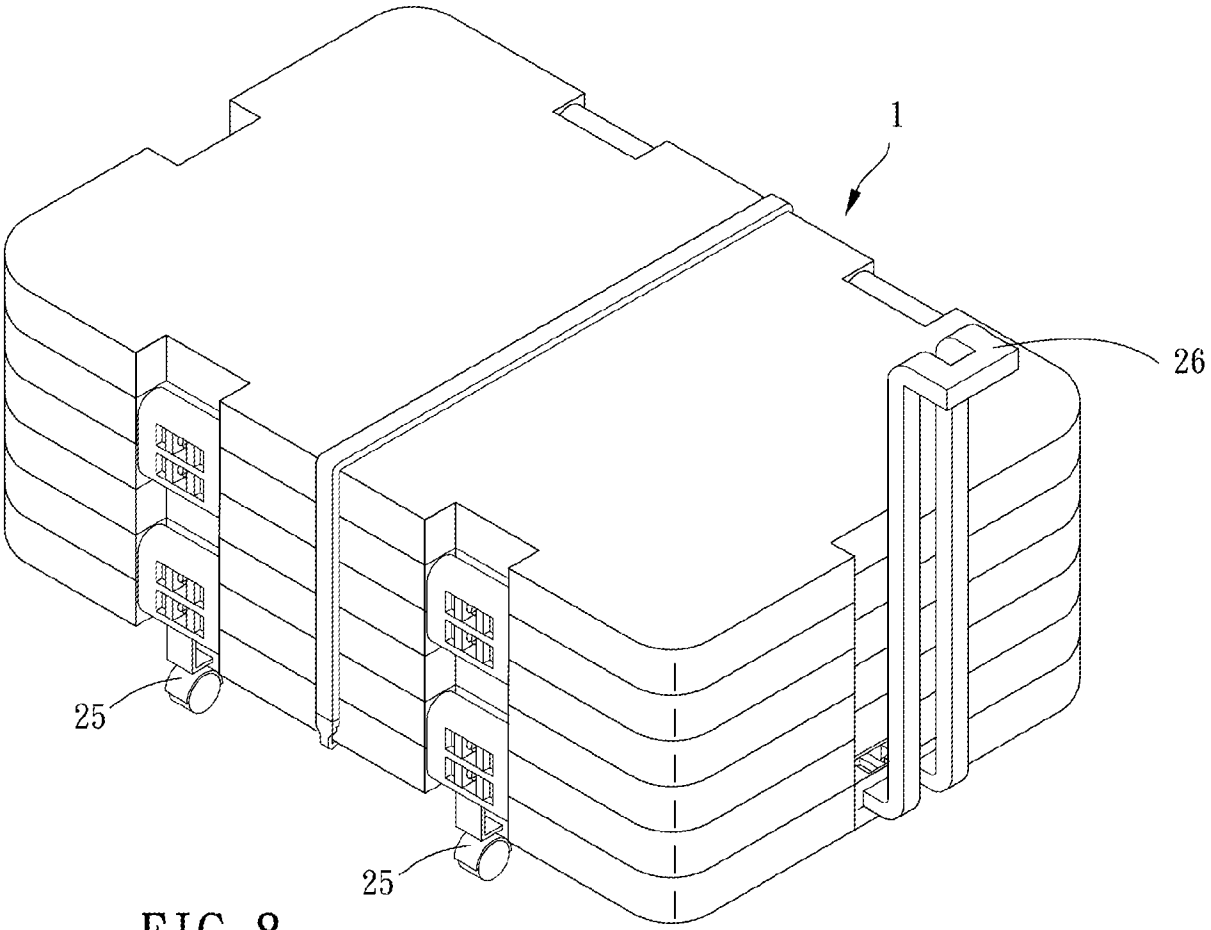

Thereby, in actual use, each board member 1 is assembled to another board member 1 through the connecting member 2 (please refer to FIGS. 1 and 2), which means that two the second connecting portions of the connecting member 2 are used to respectively assemble to the two board members 1 to combine the tool boxes of the present invention. In other ways of application, a plurality of connecting members can be assembled to a plurality of board members to form a plane (FIG. 3), a stepped structure (FIG. 4) or a three-dimensional structure (FIG. 5). Users can assemble the board members according to their preferences or environmental needs, and the board members can be separated and piled up after use, so it is convenient and practical. Furthermore, in this embodiment, the first connecting portions 13 of the two board members 1 are correspondingly arranged, so the first connecting member 13 of the two board members 1 can aim at and be assembled to the connecting member 2 when the two board members are assembled together (shown in FIG. 2). Through the arrangement of the connecting members 2, the first connecting portion of the present invention doesn't need to be processed with staggered position (the conventional connecting structures are arranged in staggered position, so it has problems such as difficulty for processing and oblique pivotal axle). Therefore, compared to the exist tool boxes which require at least two molds, the present invention requires only a single mold of board member and helps to decrease 50% of the cost of molding. Furthermore, through the first connecting portions and connecting members correspondingly disposed, the stability of the connection among boards becomes stronger, and the board members in one shape can be connected on a plane (shown in FIGS. 3 and 6), piled up (shown in FIG. 8) or assembled into a three-dimensional structure (shown in FIGS. 4 and 5).

Figure 6:
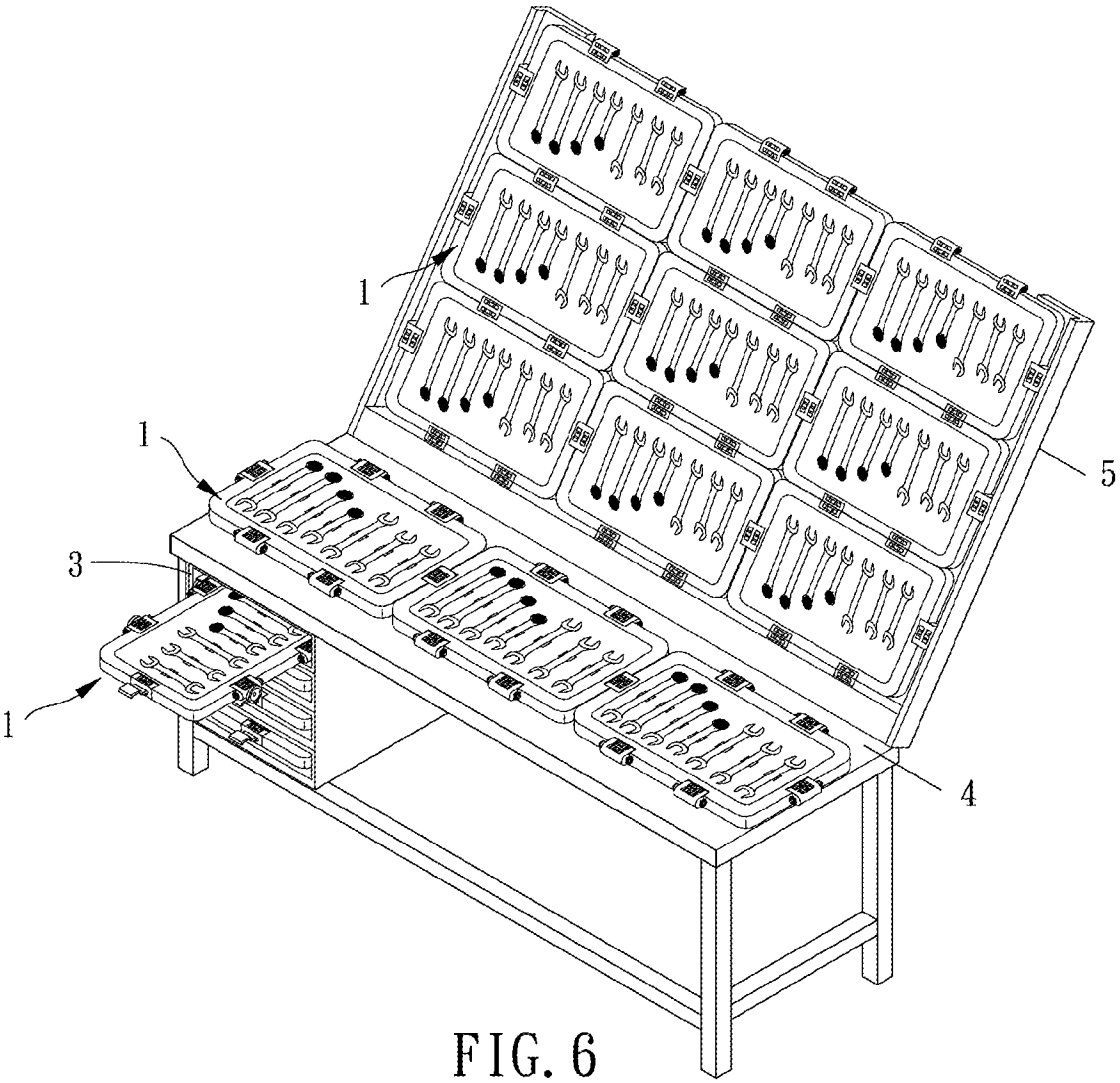

In addition, the tool box of the present invention can be combined and placed on a working desk (please refer to FIG. 6). Part of the board members 1 is disposed in a drawer 3 of the working desk, part of the board members 1 can be placed on the desk surface 4, and part of the board members 1 can be obliquely disposed on an L-bracket 5 so as to achieve the function of storage and display.

Figure 7:
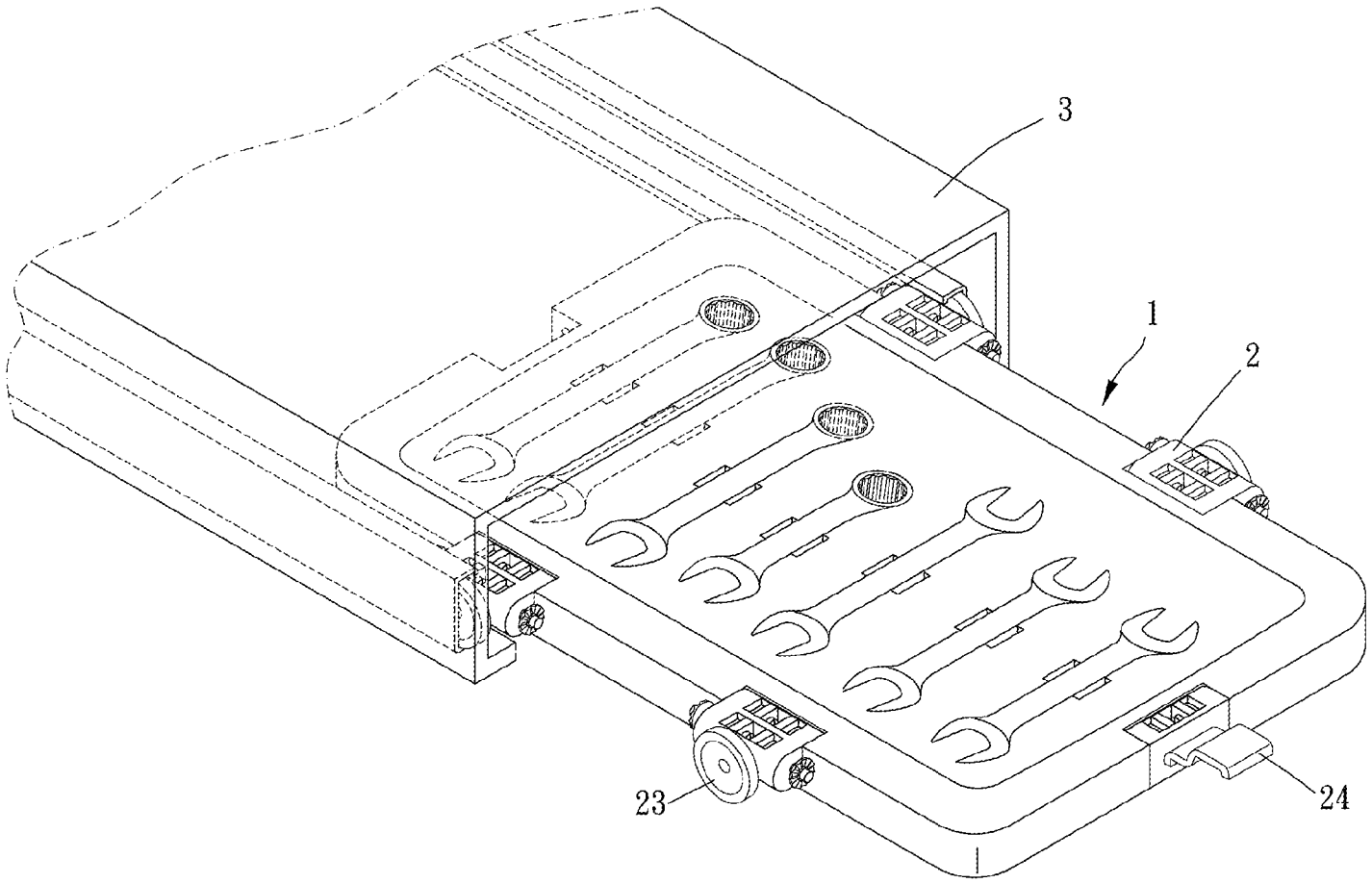

In other ways of application, the connecting member can be provided with a roller and a handle to increase its practicability. Please refer to FIGS. 6 and 7, the connecting members 2 disposed on the two sides of the board member 1 are formed with detachable rollers 23. The rollers 23 correspond to sliding channels of the drawer 3. An end of the connecting member 2 is provided with a handle 24 in upside-down U shape. Therefore, the board member 1 can be slidably disposed in the drawer 3, and the handle 24 can be used to drag and move the board member 1 (wherein mounting holes can be provided on the connecting members 2 for the roller 23 and the handle 24 to assemble therein). Please refer to FIG. 8 for another way of application. A plurality of board members 1 are piled up, the connecting members 2 at the bottom are provided with rollers 25 which can move on the ground, and the connecting members 2 at an end are formed with an extended and bent auxiliary handle 26. Thereby, the board members 1 which are piled up can be moved like a car being pushed so as to increase the convenience of moving the board members 1. Besides, the first connecting portion on the long lateral face is pivoted to the connecting member in staggered position, so users can hold on to the top board member to quickly display the board members on a plane like FIG. 3 and can quickly find the tools they need. The above-mentioned roller, handle, auxiliary handle and connecting member can also be integrally disposed, but it is preferable that the roller, handle or auxiliary handle are movably inserted or connected so as to decrease the cost of molding.

Figure 9:
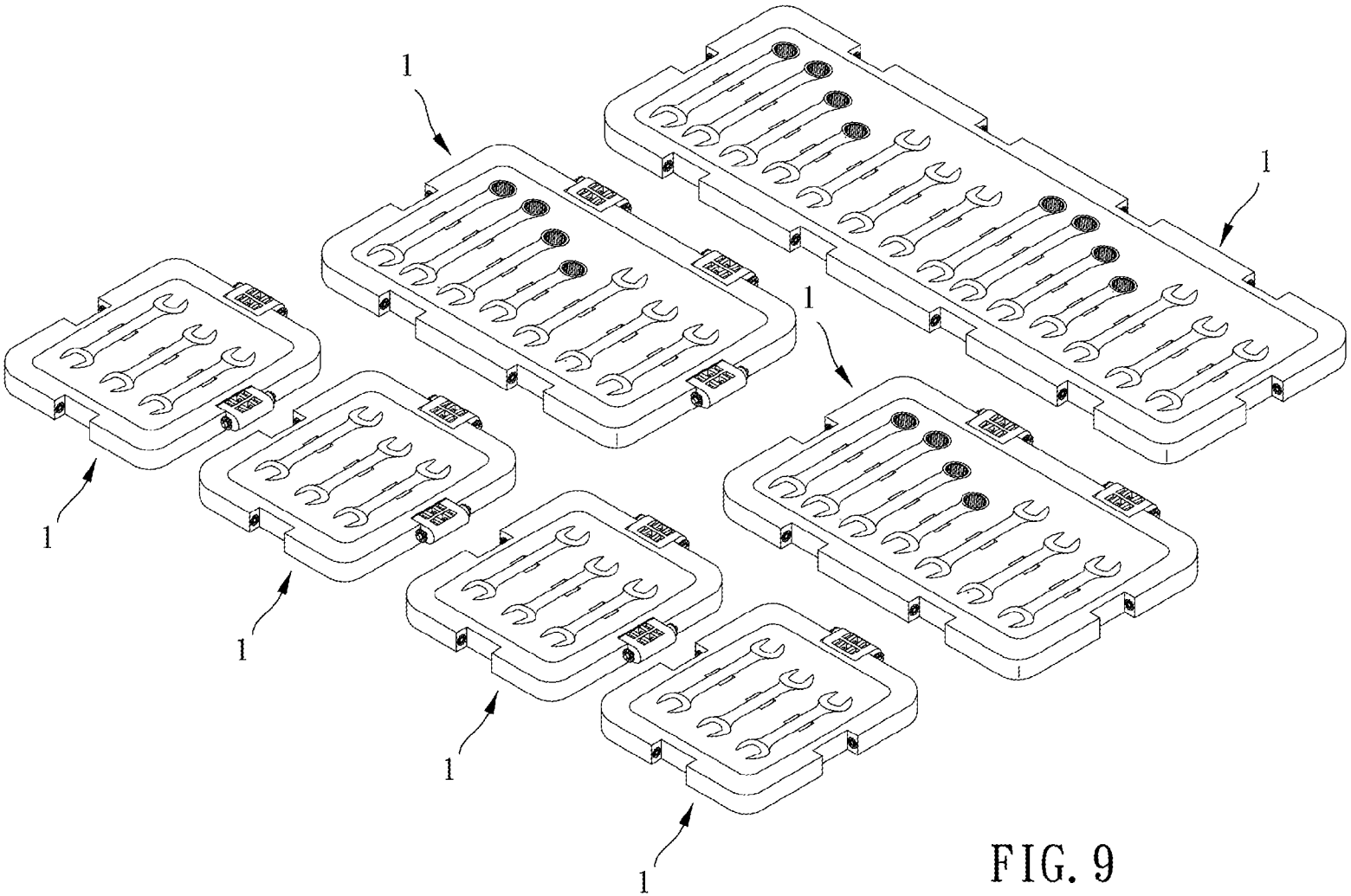
FIGS. 9 to 13 are illustrations of other embodiments of the present invention.

In addition to the above-mentioned embodiments, the size of the board member 1 can be adjusted such as a large board member 1' shown in the upper-right corner of FIG. 9. The long lateral face of the large board member 1' is provided with four first connecting portions for the connecting members to pivotally connect thereto. In the middle of FIG. 9 is a medium board member 1. The long lateral face of the medium board member 1 is provided two first connecting portions for the connecting members to pivotally connect thereto. The two medium board members 1 can be pivoted with each other to construct a large board member 1'. A small board member 1" is shown in the lower-left corner of FIG. 9. The long lateral face and the short lateral face of the small board member 1" are respectively a single first connecting portion cooperating with a single connecting member. Two of the small board members 1" can be pivoted together to construct a medium board member 1, and four of the small board members 1" can be assembled into a large board member 1'. Through the change of size of the board members, users can not only connect the board members in one size but also assemble the board members in different sizes to construct a display wall.

Furthermore, in other embodiments, the first connecting portion can be disposed only on two lateral faces of the board member, and the two lateral faces formed with the first connecting portions are two neighboring lateral faces; thereby, two board members can be connected to the two neighboring lateral faces of a board member. However, the flexibility of this embodiment is not as good as that of the embodiment whose long and short lateral faces are both formed with the first connecting portion.

Figure 10:
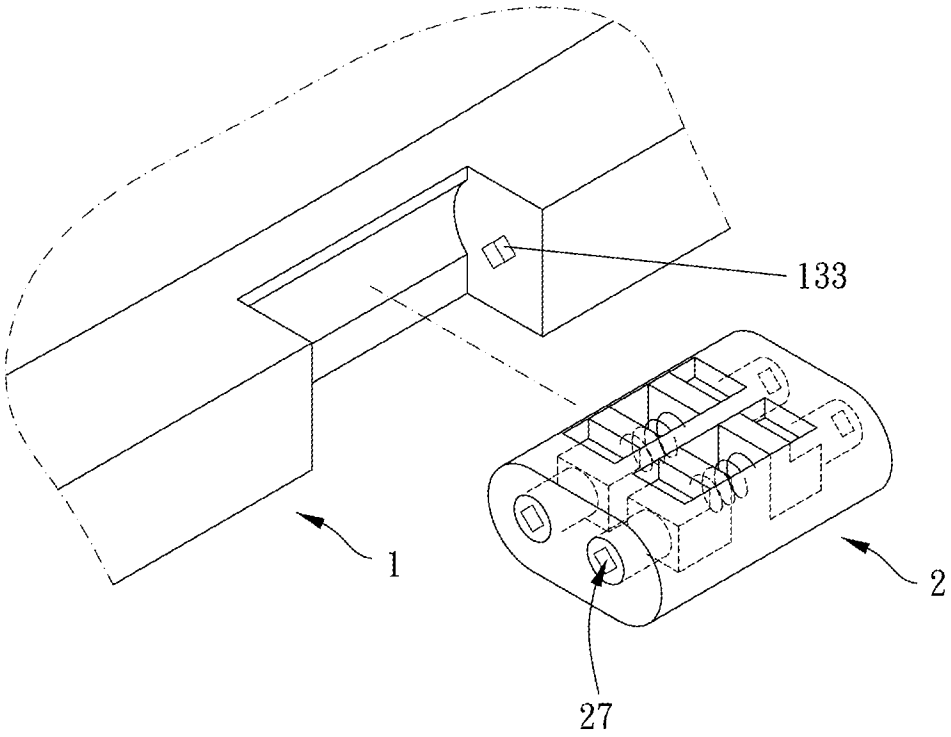

In other embodiments (please refer to FIG. 10), the two lateral faces of the first connecting portion of the board member 1 can be mounting holes, and the two lateral faces of the recession can also be formed with two protruding blocks 133 (it has to be polygonal) protruded on the same axle. The two connecting portions are formed with two connecting axles parallel to each other, and the two parallel connecting axles are two separate axial rods. An end of each separate axial rod is exposed, and the other end is connected with a shifting block. An elastic member is disposed between and abutted against the two shifting blocks. The exposed end of the axial rod of the connecting axle is formed with a bearing hole 27. The two connecting axles are assemblable to or disassemblable from the two protruding blocks 133 when the shifting block is pressed.

Figure 11:
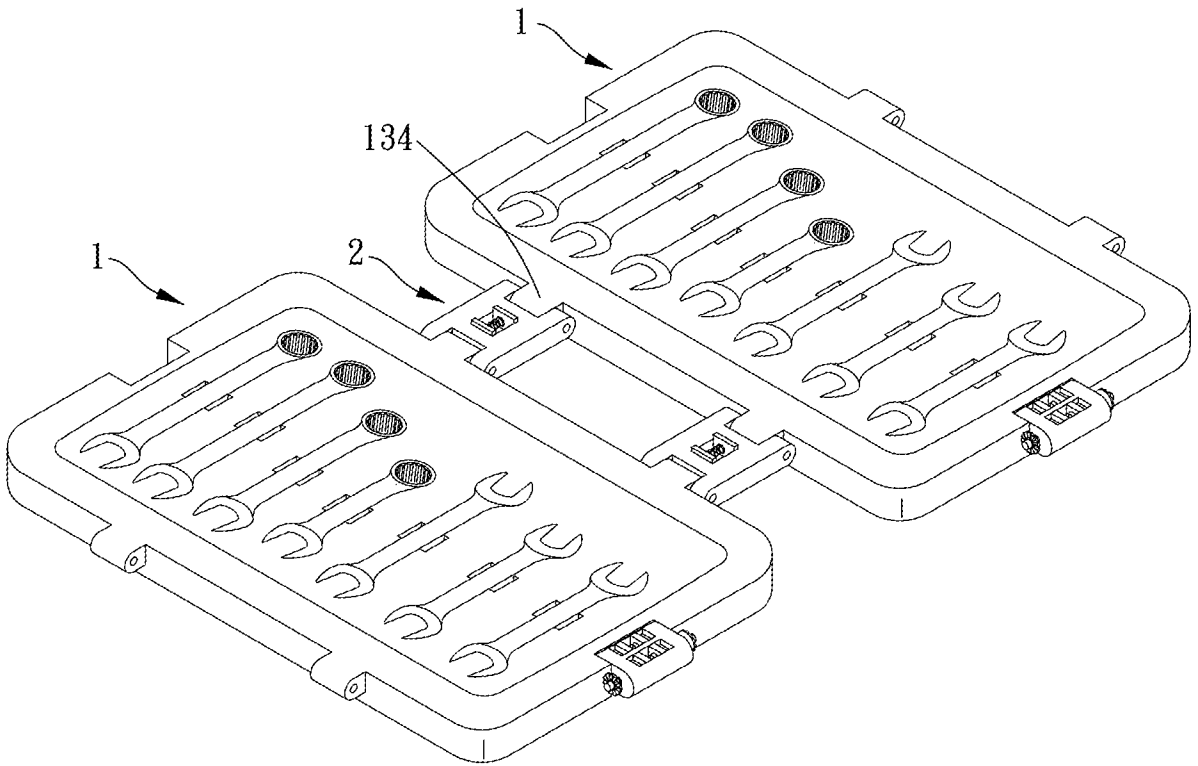
Figure 12:
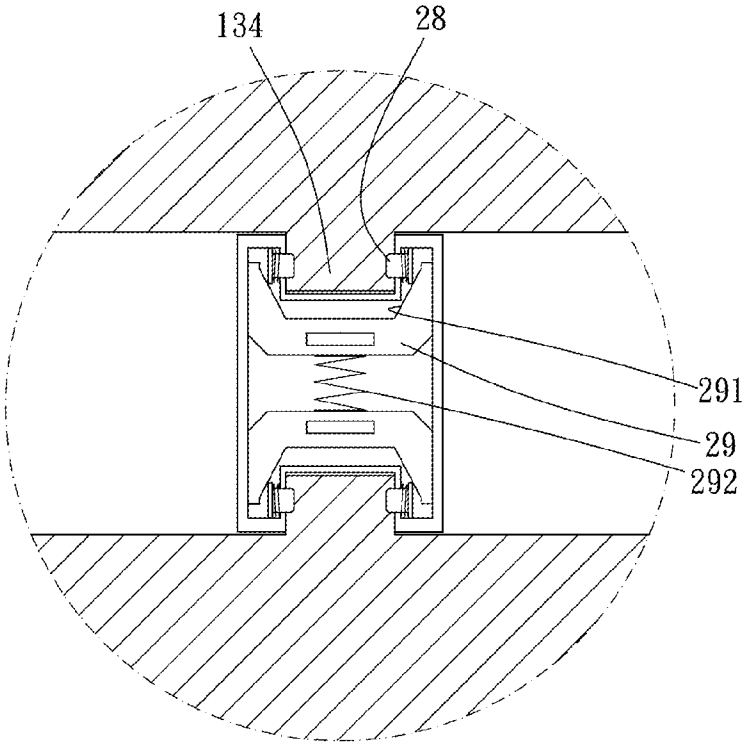
Figure 13:
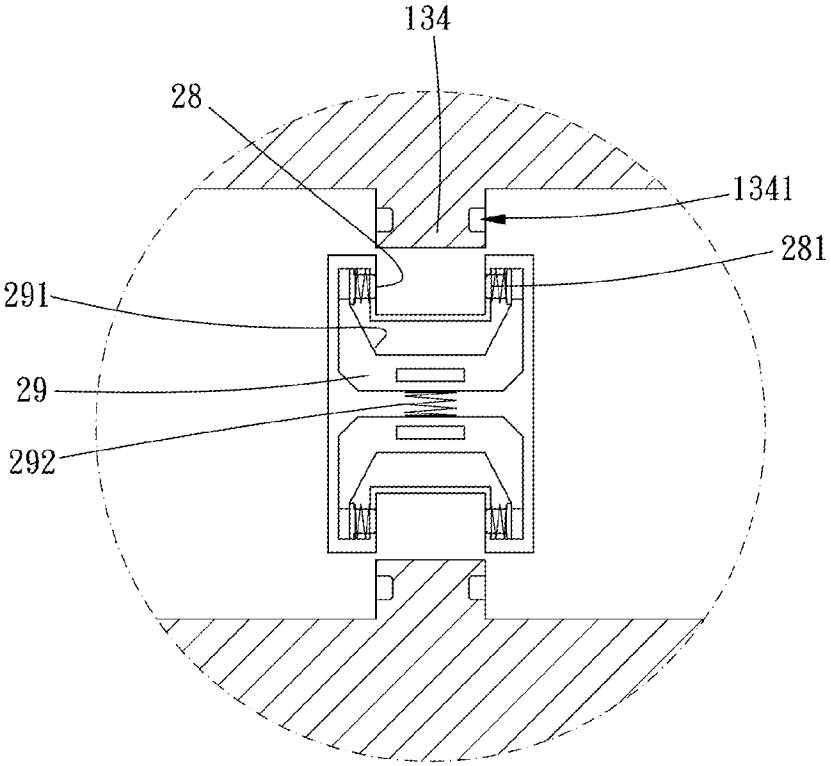
Figure 14A:
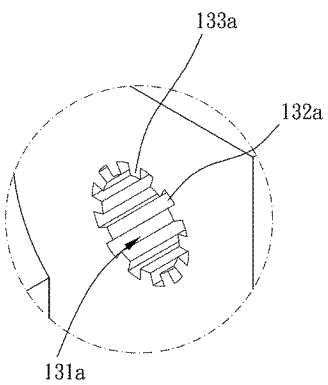
FIGS. 14, 14A, 15 and 16 are illustrations of an alternative embodiment of the present invention.
Figure 14:
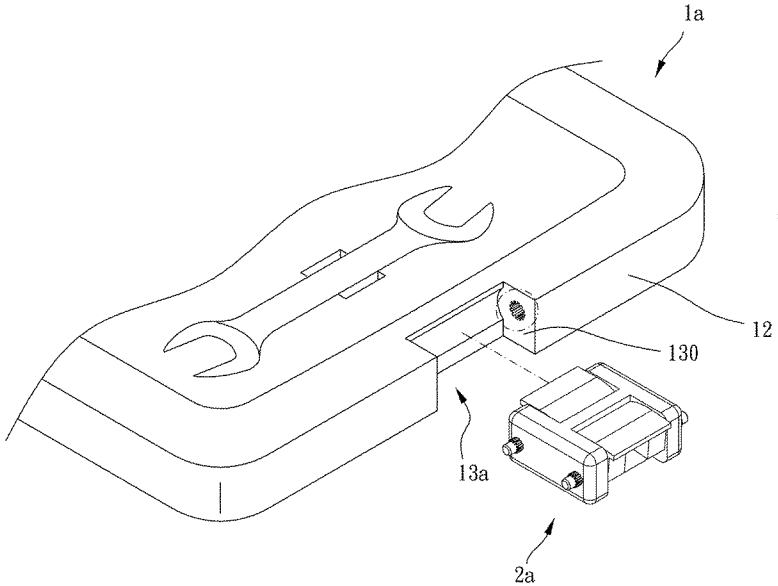
Figure 15:
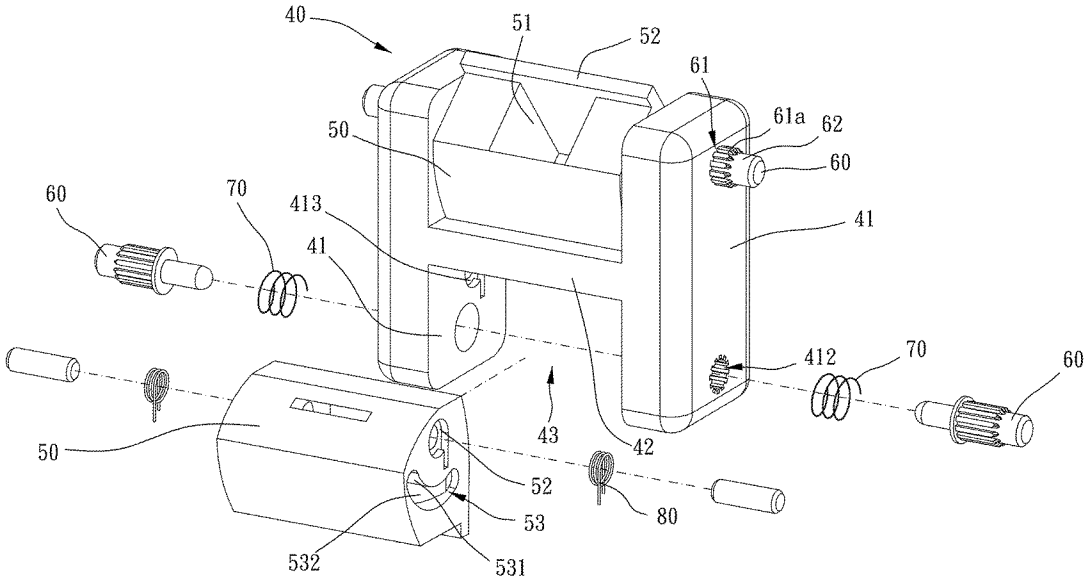
Figure 16:
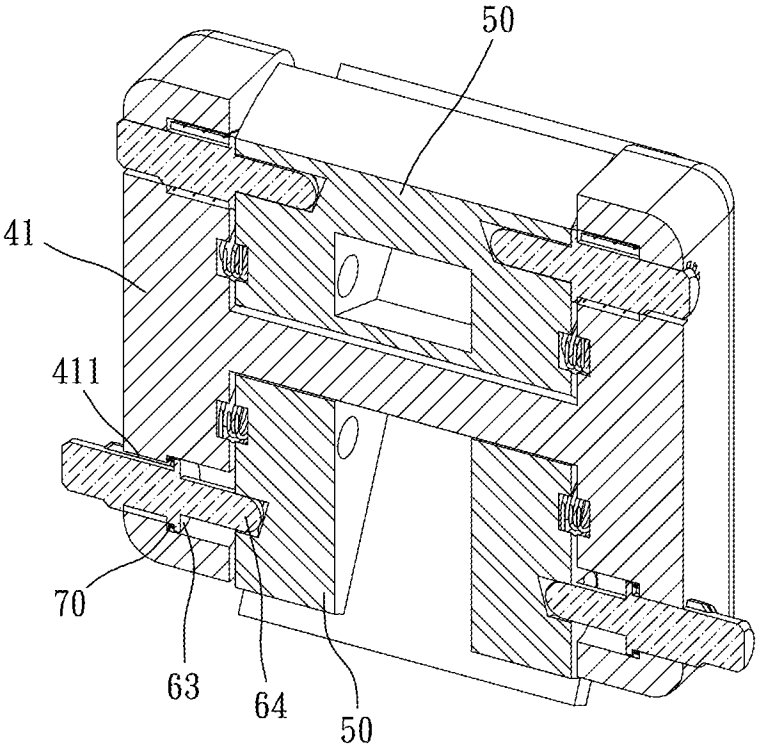

Moreover, in other embodiments of the present invention (please refer to FIGS. 11 to 13), the first connecting portion of the board member 1 is the protruding portion 134 protruded on the lateral face of the board member 1. Preferably, two ends of the protruding portion 134 are aligned with the two surfaces of the board member 1. Two corresponding lateral faces of the first connecting portion of the protruding portion 134 are formed with a mounting hole 1341. The second connecting portion of each connecting member 2 is a receiving hole, and the receiving hole is formed with two movable positioning protrusions 28. Through movement, the positioning protrusion 28 can extend into the receiving hole. The second connecting portion has an abutting member 29 which is substantially in upside-down U shape, and the abutting member 29 has an oblique face 291. The positioning protrusion 281 is formed with an elastic member 281, and the elastic member 281 can abut against the positioning protrusion 28 to move toward the oblique face 291. When the abutting member 29 is moved, it drives the oblique face 291 to abut against the positioning protrusion 28 so as to achieve the aim of controlling the positioning protrusion 28 to restrictedly move in the receiving hole; therefore, the positioning protrusion 28 can be used to be fixedly inserted in the mounting hole 1341 (wherein the two second connecting portions are design as a pair, the elastic member 292 is disposed between the two abutting members 29, so the two abutting members 29 can elastically abut against each other and move toward the other end). Thereby, when being assembled, the protruding portion 134 extends in the receiving hole, and the two positioning protrusions 28 are rotatably inserted in the two mounting holes 1341. Because the elastic member 281 and the oblique face 291 are abutted against each other, the positioning protrusion 28 will remain fixedly disposed in the mounting hole 1341 (shown in FIG. 12). When being disassembled, the abutting member 29 is moved backward (the two abutting members 29 can be clipped on and moved backward at the same time), and the thickness of the oblique face 291 will decrease so as to allow the positioning protrusion 28 to retract from the mounting hole 1341 (shown in FIG. 13) and to separate the connecting member 2 from the board member 1. Consequently, when the present invention is designed or manufactured, the first connecting portion could be a protruding or a recessed structure in accordance with various requirements.

In an alternative embodiment as shown in FIGS. 14, 14A, 15 and 16, each lateral face 12 of each board member 1*a* is formed with at least one notch 13*a*, each notch 13*a* has two first sidewalls 130 opposite to each other, and each first sidewall 130 is formed with a mounting hole 131*a* and a first toothed portion 132*a*. The connecting member 2*a* includes a main body 40 detachably received in one of the notch 13*a* and having two second sidewalls 41 which correspond to the two first sidewalls 130 respectively, two blocks 50 separately arranged, and four connecting axles 60.

Every connecting axle 60 has a second toothed portion 61 and a non-toothed distal portion 62, every two of the four connecting axles 60 are axially retractably disposed through the two second sidewalls 41 respectively and non-rotatable relative to the two second sidewalls 41 respectively. Each block 50 is operable between a lock position and a release position and cooperates with two of the four connecting axles 60 so that each of the connecting axles 60 is axially movable between a latch position and a retracted position. Preferably, each mounting hole 131*a* has a non-toothed bottom section into which one of the non-toothed distal portions 62 can be inserted. Preferably, the non-toothed distal portions 62 and the non-toothed bottom section have very close dimensions, so that the non-toothed distal portions 62 can be stably received and held within the non-toothed bottom section and provide enhanced combination strength.

When respective one of the two blocks 50 is in the lock position, respective two of the four connecting axles 60 are driven to the latch position, every second toothed portion 61 and every non-toothed distal portion 62 of respective one of the connecting axles 60 are protrusive outside one of the two second sidewalls 41 and inserted in to one of the mounting holes 131*a*, and every second toothed portion 61 of respective one of the connecting axles 60 is non-rotatably engaged with one of the first toothed portions 132*a*. When respective one of the two blocks 50 is in the release position, respective two of the four connecting axles 60 are driven to the retracted position, and every second toothed portion 61 and every non-toothed distal portion 62 of respective one of the connecting axles 60 are entirely retracted into one of the two second sidewalls 41.

Specifically, each first toothed portion 132*a* has a plurality of teeth 133*a* arranged circumferentially around one of the mounting hole 131*a*, and each second toothed portion 61 has a plurality of teeth 61*a* arranged circumferentially on one of the axles 60. The respective teeth 133*a*, 61*a* of the first and second toothed portions 132*a*, 61 restrict relative rotation and position of the board member 1*a* and the connecting member 2*a* when respective one of the two blocks 50 is in the lock position.

Each second sidewall 41 has a through hole 411 through which one of the axles 60 is disposed, a circumferential surface around the through hole 411 is provided with a third toothed portion 412 which preferably correspond to the second toothed portion 61 in shape, and every second toothed portion 61 is non-rotatably and axial-movably engaged with one of the third toothed portion 412. Therefore, the connecting axle 60 is non-rotatably assembled to the main body 40.

Preferably, each block 50 is swingably pivoted to the two second sidewalls by two pins, and each block 50 includes a room 51 between the two second sidewalls 41 and a flange 52 extending between the two second sidewalls 41 and adjacent to the room 51, for facilitating grip of a finger to rotate the main body 40.

The main body 40 further includes a partition wall 42 perpendicularly connected between the two second sidewalls 41, the partition wall 42 and the two second sidewalls 41 form two receiving spaces 43 at two corresponding sides of the partition wall 42, and each of the two receiving spaces 43 receives one of the blocks 50. The partition wall 42 avoids interference of the two blocks 50.

Each of the connecting axles 60 is further provided with a radial protrusion 63 which is greater than the through hole 411. Two ends of the second toothed portion 61 of respective one of the connecting axles 60 are respectively connected with one of the radial protrusions 63 and one of the non-toothed distal portions 62. Each side of each block 50 facing one of the second sidewalls 41 is further provided with a sliding track 53 which is tilted relative to one of the second sidewalls 41, and each axle 60 further includes a leg 64 connected with one of the radial protrusions 63 and slidably disposed into one of the sliding track 53. Each leg 64 cooperates with one of the sliding tracks 53 so that sliding of the leg 64 along the sliding track 53 operates to axially move one of the connecting axles 60 between the latch position and the retracted position. The sliding track 53 includes a sliding groove 531 having a cam surface 532 or a ramp abutting against one of the legs 64. However, each connecting axle may be provided with a radial protrusion which is greater than the through hole without any legs, and the radial protrusion such as a C-clip is slidably restrained within a groove having a long narrowed opening tilted relative to one of the second sidewall.

Preferably, an elastic member 70 (such as a coil spring) is disposed between one of the second sidewalls 41 and one of the radial protrusions 63 and disposed around one of the axles 60, and the elastic member 70 urges one of the axles 60 toward one of the blocks 50. Each second sidewall 41 may be further provided with a 9-shaped recess 413, each 9-shaped recess 413 receives a torsional member 80 (such as a torsional spring), and the torsional member 80 is further received within a 9-shaped recess 52 of one of the blocks 50. The elastic member 70 can make the axle 60 entirely retract into one of the two second sidewalls 41 automatically as the block 50 is in the release position. Preferably, the torsional member 80 has greater resilience than the elastic member 70, so that the block 50 in the release position can return to the latch position automatically so as to ensure the combination of the board member 1*a* and the connecting member 2*a*.

In practice, as the block 50 is rotated toward the partition wall 42, the sliding track 53 guides the connecting axle 60 to move axially away from the block 50, the connecting axle 60 is driven to the latch position, and the board member 1*a* and the connecting member 2*a* are assembled together and non-rotatably held in a specific included angle. As the block 50 is rotated away from the partition wall 42, the sliding track 53 guides the connecting axle 60 to move axially toward the block 50, the connecting axle 60 is driven to the latch position, and the board member 1*a* and the connecting member 2*a* are detachable from each other.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tool box, including at least two board members and a connecting member, each board member having two corresponding surfaces and a plurality of lateral faces, wherein one of the corresponding surfaces is formed with at least one tool receiving portion, each lateral face is formed with at least one notch, each notch has two first sidewalls opposite to each other, each first sidewall is formed with a mounting hole and a first toothed portion, the connecting member includes a main body detachably received in one of the at least one notch and having two second sidewalls which correspond to the two first sidewalls respectively, two blocks separately arranged, and four connecting axles, every connecting axle has a second toothed portion and a non-toothed distal portion, every two of the four connecting axles are axially retractably disposed through the two second sidewalls respectively and non-rotatable relative to the two second sidewalls respectively, each block is operable between a lock position and a release position and cooperates with two of the four connecting axles so that each of the connecting axles is axially movable between a latch position and a retracted position; wherein when respective one of the two blocks is in the lock position, respective two of the four connecting axles are driven to the latch position, every second toothed portion and every non-toothed distal portion of respective one of the connecting axles are protrusive outside one of the two second sidewalls and inserted in to one of the mounting holes, and every second toothed portion of respective one of the connecting axles is non-rotatably engaged with one of the first toothed portions; wherein when respective one of the two blocks is in the release position, respective two of the four connecting axles are driven to the retracted position, every second toothed portion and every non-toothed distal portion of respective one of the connecting axles are entirely retracted into one of the two second sidewalls.

2. The tool box of claim 1, wherein each first toothed portion has a plurality of teeth arranged circumferentially around one of the mounting hole.

3. The tool box of claim 1, wherein each second toothed portion has a plurality of teeth arranged circumferentially on one of the connecting axles.

4. The tool box of claim 1, wherein each second sidewall has a through hole through which one of the connecting axles is disposed, a circumferential surface around the through hole is provided with a third toothed portion, and every second toothed portion is non-rotatably and axial-movably engaged with one of the third toothed portion.

5. The tool box of claim 1, wherein each block includes a room between the two second sidewalls.

6. The tool box of claim 1, wherein each block includes a flange extending between the two second sidewalls.

7. The tool box of claim 6, wherein each block includes a room between the two second sidewalls, and the flange is adjacent to the room.

8. The tool box of claim 1, wherein the main body further includes a partition wall perpendicularly connected between the two second sidewalls, the partition wall and the two second sidewalls form two receiving spaces at two corresponding sides of the partition wall, and each of the two receiving spaces receives one of the blocks.

9. The tool box of claim 1, wherein each second sidewall has a through hole through which one of the connecting axles is disposed, each of the connecting axles is provided with a radial protrusion which is greater than the through hole, two ends of the second toothed portion of respective one of the connecting axles are respectively connected with one of the radial protrusions and one of the non-toothed distal portions, each side of each block facing one of the second sidewalls is further provided with a sliding track which is tilted relative to one of the second sidewalls, each connecting axle further includes a leg connected with one of the radial protrusions and slidably disposed into one of the sliding track, each leg cooperates with one of the sliding tracks so that sliding of the leg along the sliding track operates to axially move one of the connecting axles between the latch position and the retracted position.

10. The tool box of claim 9, wherein the sliding track includes a sliding groove having a cam surface abutting against one of the legs.

11. The tool box of claim 9, wherein an elastic member is disposed between one of the second sidewalls and one of the radial protrusions, and the elastic member urges one of the connecting axles toward one of the blocks.

12. The tool box of claim 1, wherein each second sidewall is further provided with a 9-shaped recess, each 9-shaped recess receives a torsional member, and the torsional member is further received within a 9-shaped recess of one of the blocks.

13. The tool box of claim 1, wherein each block is swingably pivoted to the two second sidewalls.

* * * * *